US006099689A

United States Patent [19]

Pruszynski et al.

[11] Patent Number: 6,099,689

[45] Date of Patent: Aug. 8, 2000

[54] PRODUCTION OF PAPER AND BOARD PRODUCTS WITH IMPROVED RETENTION, DRAINAGE AND FORMATION

[75] Inventors: Przemyslaw Pruszynski; J. R. Armstrong, both of Burlington; R. Jakubowski, Hamilton, all of Canada

[73] Assignee: Nalco Chemical Company, Naperville, Ill.

[21] Appl. No.: 09/024,900

[22] Filed: Feb. 17, 1998

[51] Int. Cl.[7] ..... D21H 21/10

[52] U.S. Cl. ..... 162/158; 162/164.1; 162/168.1; 162/168.2; 162/168.3; 162/183; 162/190

[58] Field of Search ..... 162/168.1, 168.2, 162/168.3, 164.1, 158, 183, 181.8, 190

[56] References Cited

U.S. PATENT DOCUMENTS

| | | | |
|---|---|---|---|
| 4,066,495 | 1/1978 | Voigt et al. . | |
| 4,388,150 | 6/1983 | Sunden et al. . | |
| 4,749,444 | 6/1988 | Lorz et al. . | |
| 4,902,382 | 2/1990 | Sakabe et al. . | |
| 4,913,775 | 4/1990 | Langley et al. . | |
| 5,185,062 | 2/1993 | Begala . | |
| 5,223,098 | 6/1993 | Cluyse et al. | 162/181.8 |
| 5,401,363 | 3/1995 | Begemann et al. | 162/183 |
| 5,501,774 | 3/1996 | Burke . | |
| 5,560,807 | 10/1996 | Hauser | 162/183 |
| 5,571,380 | 11/1996 | Fallon . | |
| 5,595,629 | 1/1997 | Begala . | |
| 5,629,368 | 5/1997 | Chung . | |
| 5,670,021 | 9/1997 | Owens . | |
| 5,779,859 | 7/1998 | Carter et al. | 162/181.8 |

FOREIGN PATENT DOCUMENTS

| | | |
|---|---|---|
| 0 361 763 | 4/1990 | European Pat. Off. . |
| 812896 | 1/1985 | Finland . |
| WO 93/15271 | 8/1993 | WIPO . |
| WO 95/21295 | 8/1995 | WIPO . |
| WO 95/33096 | 12/1995 | WIPO . |

*Primary Examiner*—Peter Chin
*Attorney, Agent, or Firm*—Hill & Simpson

[57] ABSTRACT

A papermaking process with maintained retention and improved formation is provided. The papermaking process includes the step of adding bentonite to the white water prior to the exposure of the white water to the shear stages of the papermaking system. The bentonite may be added anywhere from the white water silo up to the introduction of the white water to the fan pump. The flocculant may also be added to the white water with or shortly after the addition of the bentonite or a split feed of flocculant may be provided whereby some of the flocculant is added to the white water and an additional portion of flocculant is added to the thin stock prior to the entry of the thin stock into the header box.

4 Claims, 3 Drawing Sheets

PRODUCTION OF PAPER AND BOARD PRODUCTS WITH IMPROVED RETENTION, DRAINAGE AND FORMATION

BACKGROUND OF THE INVENTION

The present invention relates to the field of papermaking and, more specifically, to the production of paperboard. Still more specifically, the present invention relates to use of wet-end additives to the furnish or stock.

In the manufacture of paper and paperboard, an aqueous slurry of cellulosic fibers is prepared and delivered to a draining wire screen which results in the formation of a mat on the screen and the draining of an aqueous suspension known as white water through the screen. The white water is subsequently recycled. The aqueous cellulosic suspension or slurry that is delivered to the screen is known as the thin stock.

The amount of cellulosic fibers in the thin stock typically ranges from about 0.5% to about 1%. The thin stock is typically prepared from another aqueous solution or slurry of cellulosic fibers known as the thick stock that has been diluted with recycled white water. The thin stock also includes a number of different additives which are introduced to the system after the dilution of the thick stock with the white water. The amount of cellulosic fibers in the thick stock typically is about 3% while the amount of cellulosic fibers in the white water is typically less than 1%.

By way of example only, a simplified and abbreviated flow sheet of one paper or paperboard making process is shown in FIG. 1. It will be noted that FIG. 1 illustrates just one of many different paper and board making processes to which the present invention applies. the use of FIG. 1 for illustration purposes is not intended to limit the methods of the present invention to the processes illustrated in FIG. 1. Rather, the inventive methods can be used to improve board and papermaking processes for dual former machines, gap former machines and other machines in addition to the Fourdrinier processes illustrated in FIG. 1. The system 10 includes a head box 11 and a wire screen shown at 12 which is an endless wire screen on which the thin stock is fed. FIG. 1 represents one design known as a fourdrinier paper machine. Similar principles apply to other paper making machine designs. The head box 11 receives the thin stock from the line 13 and delivers the thin stock slurry to the wire 12. As a result, a mat is formed on the wire 12 and finally transported out of the system as a sheet 14.

The bulk of the water from the thin stock is drained from the mat that is formed on the wire 12 and is recycled through the line 15 as white water. The white water is collected in the white water silo 16 where it is recycled mainly to a primary pump shown at 17.

In the system 10 shown in FIG. 1, the pump 17 includes two inlets 18, 19. The inlet 18 receives white water flowing through the line 21 from the white water silo 16. The inlet 19 receives thick stock flowing through the line 22 from the machine chest 23. The pump 17 mixes the white water and thick stock 19 to produce a thin stock which is pumped through the line 24 finally into a pressure screen shown at 25. The combination of the action of the pump 17, pressure screen 25 and additional shear imposing components such as a vortex cleaner (not shown) in combination with additional pressure screens results in a thorough mixing of the thin stock.

In the production of any high quality paper or paperboard, three characteristics are required: drainage; retention; and formation.

First, the liquid components of the thin stock must drain well from the wire 12 so that a mat or sheet having a low water content is formed on the wire 12 and produced at 14 for drying.

Second, thin stock also includes a number of additives and fines which are small particles of fiber that are shorter than normal wood pulp fibers. In order to produce paper efficiently and in order to produce paper that uses less cellulosic fibers, it is extremely important that the mat or sheet retain the cellulosic fines and other additives that are suspended in the thin stock. Thus, in addition to the importance of drainage to the paper formation process, it is also important to effectively retain additives, fillers and fines in the mat.

Third, formation is a measure of the uniformity of the paper sheet and is generally determined by variances in the transmission of light through a paper sheet, high variance being indicative of poor formation and poor paper quality.

In order to increase retention, additives are added to either the thin stock or thick stock in the form of coagulants and flocculants. Specifically, coagulants are low molecular weight cationic synthetic polymers or cationic starches which generally reduce the negative surface charges present on the mineral fillers and cellulosic fines present in the thin stock which results in an agglomeration of the particles. The agglomeration of the particles assists in the retention of the particles in the web or sheet.

Additionally, flocculants are utilized which are generally high molecular weight anionic synthetic polymers which bridge the agglomerated particles from one surface to another thereby binding the particles into larger agglomerates. The presence of these larger agglomerates in the thin stock increases retention further. The larger agglomerates are better retained in the mat.

However, the use of retention aides such as coagulants and flocculants has the tendency of compromising formation properties in the paper because large agglomerates tend to contribute to nonuniformity of the mat and therefore the finished paper sheet or board. Hence, if the flocculation, especially homoflocculation of fiber, is increased to an excessive degree, formation will be compromised and the quality of the resulting product will suffer.

One particular filler or additive which has been used in the papermaking industry to a large degree is bentonite. Bentonite is a naturally occurring clay comprising minerals that swells and forms a colloidal aqueous suspension. Bentonite is used as a pitch remover in papermaking water systems, as well as a retention additive, a microparticle and as a filling agent. The use of bentonite in the presence of other retention aides such as coagulants and flocculants requires certain considerations.

Specifically, because bentonite has flocculating properties, there is a danger that the combination of bentonite and a flocculant or coagulant will result in excessively large agglomerates which will adversely affect the formation qualities of the paper. As a result, bentonite is often added after the thin stock has passed through the primary pump 17 and pressure screen 25 (as well as any additional shear imposing components such as vortex cleaners) and just before the thin stock enters the head box 11. By adding bentonite after the thin stock is treated with coagulants and flocculants and mixed in the pump 17 and is passed through the pressure screen 25 as well as any other shear imposing components such as vortex cleaners (not shown), it is believed that the creation of large bentonite containing agglomerates can be controlled.

There is a need for an improved papermaking and paperboard making process utilizing bentonite which provides the paper manufacturer with greater flexibility as to where the bentonite is added to the system. An improved process would allow papermakers to better balance the performance by allowing for increase of retention and drainage while not adversely affecting formation.

SUMMARY OF THE INVENTION

The present invention provides an improved method of making paper using bentonite as an additive by enabling the bentonite to be added to the white water loop, for example, at the white water silo, the exit to the white water silo, or between the white water silo and the fan pump. The method of the present invention enables the bentonite to be added to either the white water prior to the point where the white water is being mixed with the thick stock and therefore prior to shear stages such as the fan pump, pressure screens and vortex cleaners.

Pursuant to the present invention, bentonite is added to the white water streams which are mixed to form the thin stock prior to the passing of the thin stock through shear stages such as fan pumps, pressure screens, vortex cleaners and other shear imposing stages.

In an embodiment, the method of the present invention provides a method of making paper by depositing a thin stock suspension that comprises cellulosic fiber, fines, filters, and other additives and bentonite onto a wire screen to form a mat or web on the screen and a stream of white water which is drained from the screen. The method comprises the steps of collecting the stream of white water drained from the wire screen, adding bentonite to the white water, combining the white water and bentonite with a thick stock suspension that comprises water and cellulosic fibers and other additives to form the thin stock suspension, exposing the thin stock suspension to at least one shear stage such as a fan pump, pressure screen or screens or vortex cleaner, and draining the thin stock suspension on the wire screen to form the mat.

In an embodiment, the method of the present invention further comprises the step of adding a flocculant to the white water before, after or at the same place as the addition of bentonite to the white water.

In an embodiment, the method of the present invention further comprises the step of adding a flocculant to the white water and the step of adding additional flocculant to the thin stock suspension after the thick stock dilution of the fan pump, and before or after the pressure screen.

In an embodiment, the thick stock suspension further comprises a coagulant.

In an embodiment, the present invention also provides an apparatus for making filled paper. The apparatus of the present invention includes a head box for depositing a thin stock suspension that comprises cellulosic fiber and bentonite onto a wire screen on which a paper web or mat is formed and through which a white water stream is drained. The wire screen is in communication with a white water silo which collects the white water drained from the wire screen. The white water silo comprises an outlet that is in communication with a first inlet of a fan pump. The apparatus further comprises a bentonite inlet disposed between the white water silo and the fan pump. The bentonite inlet provides a means for adding bentonite to the white water prior to or contemporaneous with the white water entering the fan pump. The fan pump further comprises a second inlet that is in communication with a supply of an aqueous thick stock suspension that comprises cellulosic fibers, additives, fines, filters and a coagulant. The fan pump mixes the thick stock suspension, the white water and the bentonite to produce a thin stock suspension. The fan pump further comprising an outlet for communicating the thin stock suspension to at least one pressurized screen. The pressurized screen being in is communication with the head box.

In an embodiment, the bentonite inlet is disposed at the outlet of the white water silo.

In an embodiment, the bentonite inlet is disposed at the fan pump.

In an embodiment, the bentonite is added at a dilution headbox where water is added for cross direction basis weight control.

In an embodiment, the apparatus further comprises a flocculent inlet disposed between the white water silo and the fan pump for adding a flocculent to the white water.

In an embodiment, the apparatus further comprises a flocculent inlet disposed between the mixing point at the fan pump and the head box for adding flocculent to the thin stock suspension.

In an embodiment, the apparatus further comprises a coagulant inlet for adding a coagulant to the thick stock suspension.

In an embodiment, the apparatus further comprises a coagulant inlet disposed at the fan pump for adding a coagulant to the thin stock suspension.

An advantage of the present invention is that it enables a manufacturer to add bentonite to a papermaking system prior to the shear stages such as the fan pump, pressure screens or vortex cleaners which ensures that the bentonite has sufficiently absorbed water and is thoroughly mixed in the thin stock suspension prior to the depositing of the thin stock suspension onto the wire screen.

Another advantage of the present invention is that it provides a plurality of feeding points for bentonite that are upstream of the shear stages of a papermaking system.

Yet another advantage of the present invention is that it provides an improved means for mixing bentonite into the thin stock.

Yet another advantage of the.present invention is that it enables bentonite to be added to the thin stock and thoroughly mixed into the thin stock without adversely affecting the formation of the paper mat or web.

And another advantage of the present invention is that bentonite is added to either the white water or to the point where the white water is mixed with the thick stock, and prior to the imposition of shear stages onto the white water/thick stock mixture, thereby enabling the bentonite to be thoroughly mixed into the resulting thin stock to thereby enhance retention of the bentonite in the paper mat.

Still another advantage of the present invention is that it provides a means for enhancing retention without adversely affecting formation.

Additional features and advantages are described in, and will be apparent from the detailed description of the presently preferred embodiments and from the figures.

DETAILED DESCRIPTION OF THE PRESENTLY PREFERRED EMBODIMENTS

Figure 1:
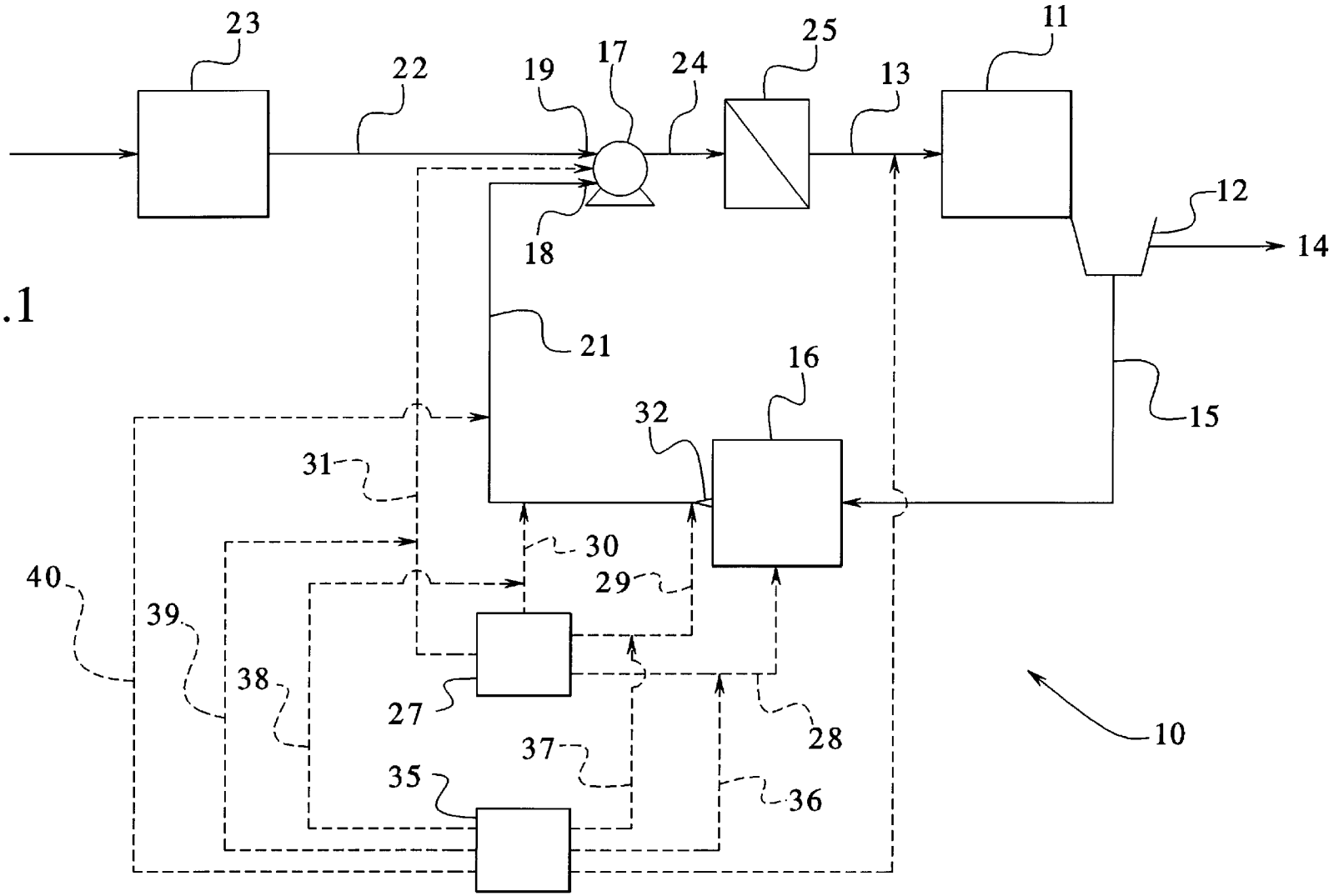
FIG. 1 illustrates, schematically, a papermaking system made in accordance with the present invention.

The present invention provides a method and apparatus for making paper with improved retention and formation qualities. In one embodiment illustrated in FIG. 1, a supply of bentonite 27 is provided and communication between the bentonite supply 27 and the system 10 is provided at a point ranging from the white water silo 16 to the fan pump 17. Specifically, bentonite may be supplied through the line 28 directly into the white water silo 16. Further, if a dilution headbox (not shown) is employed, the bentonite may be added at the dilution headbox with the water that is added for cross directional basis weight profile control. However, because the white water silo 16 may also be in communication with other vessels, some of the bentonite from the supply 27 would be distributed to other parts of the papermaking system 10 that are not illustrated in FIG. 1. This result is not disadvantageous, however, because bentonite is frequently used in papermaking systems for pitch control and therefore any bentonite distributed to other areas of the water system not shown in FIG. 1 would still prove to be useful for pitch control.

In accordance with the present invention, suitable injection points are shown by the conduits 28–31 which are connected to the white water stream anywhere between the white silo 16 and the pump 17. For example, the line 29 connected to the white water silo 16 at the outlet 32 of the white water silo 16. Further, the bentonite may be connected to the white water loop at the line 30 which is simply disposed between the outlet 32 of the white water silo 16 and the fan pump 17. Additionally, the bentonite might be supplied through a line 31 which is connected directly to the fan pump 17.

In an embodiment, a supply of flocculant 35 may also be provided. The flocculant can be added to the white water loop between the white water silo 16 and the fan pump 17, to the thin stock between the fan pump 17 and the head box 11 (and preferably after the pressure screens 25), or the addition of the flocculant may be split, part of the flocculant being added to the white water loop as discussed above and part of the flocculant being added to the thin stock as discussed above. The flocculant may also be added to the white water at any point where the bentonite from the bentonite supply 27 is added as shown by the conduits 36, 37, 38 and 39. In addition, the flocculant from the supply 35 may also be injected into the line 13 disposed between the pressure screen 25 and head box 11 as a split feed, one portion of the flocculant being added to the white water between the white water silo 16 and fan pump 17 and a second portion of the flocculant being added between a shear stage such as the pressure screen 25 and the head box 11. the flocculant may also be added directly to the white water loop independent of the bentonite (see line 40).

EXPERIMENTAL RESULTS

As shown below, it has been found that addition of the bentonite and flocculant prior to the shear stages, such as the fan pump 17, pressure screen 25 and vortex cleaner (not shown) does not adversely affect retention of fine particles in the formed paper sheet or web as previously expected. Specifically, bentonite and flocculant was added to both the thin stock and white water of two different pulps and the retention was measured. Five flocculants were utilized: (A) a nonionic flocculant comprising a homopolymer of acrylamide; (B) a copolymer of acrylamide (93 mol %) and acrylic acid (7 mol %); (C) a copolymer of acrylamide (50 wt %) and diallyldimethylaminochloride (50 wt %); (D) a cationic latex polymer comprising a copolymer of acrylamide (80 mol %) and dimethylaminoethylacrylic-methyl chloride quarternized (DMEA-MCQ) (20 mol %) having a reduced specific viscosity of 19–25 centipoise; and (E) a terpolymer comprising acrylamide, acrylic acid and DMAEA.

It will be noted that flocculant selection is highly mill specific and pulp specific. Accordingly, additional flocculants can be used with bentonite in accordance with the present invention. The selection of the flocculant for a particular mill and for a particular pulp is within the knowledge of those skilled in the art.

Retention was measured by way of a Britt Jar test. Specifically, a Britt CF dynamic drainage jar was utilized which generally consists of an upper chamber of about 1 liter capacity and a bottom drainage chamber, the chambers being separated by a bottom support screen and a drainage screen. Below the drainage chamber is a downward extending flexible tube equipped with a clamp for closure. The upper chamber is provided with a variable speed, high torque motor equipped with a two-inch three-bladed propeller to create controlled shear conditions in the upper chamber.

To test the efficacy of adding the bentonite and flocculant to the white water, the white water was placed in the upper chamber and subjected to a shear stirring. After five seconds, the bentonite was added to the white water and after an additional five seconds, the flocculant was added. After an additional five seconds, the thick stock was added and after yet an additional five seconds, the slurry was drained on the screen.

As a control, white water was added to the upper chamber and subjected to shear stirring followed by the addition of the thick stock five seconds later. After an additional five seconds, the bentonite was added, followed by the addition of the flocculant five seconds later followed by the draining on the screen five seconds after the addition of the flocculant.

The dosages of bentonite and flocculant as well as the retention results are set forth below in Table 1.

TABLE 1

| | | | First pass Retention | | First Pass Ash Retention | | Visual flocc size assessment | |
|---|---|---|---|---|---|---|---|---|
| Furnish | Bentonite (kg/t) | Flocculant (kg/t) | White Water | Thin Stock | White Water | Thin Stock | White Water | Thin Stock |
| A | 3 | A | 58 | 58 | 43 | 41 | small | large |
| A | 6 | A | 65 | 68 | 53 | 56 | small | large |
| A | 3 | B | 51 | 51 | 32 | 27 | small | large |
| A | 3 | C | 52 | 52 | 35 | 30 | small | large |

TABLE 1-continued

| Furnish | Bentonite (kg/t) | Flocculant (kg/t) | First pass Retention | | First Pass Ash Retention | | Visual flocc size assessment | |
|---|---|---|---|---|---|---|---|---|
| | | | White Water | Thin Stock | White Water | Thin Stock | White Water | Thin Stock |
| B | 3 | D | 51 | 54 | 19 | 19 | small | large |
| B | 5 | D | 56 | 53 | 27 | 17 | small | large |
| B | 3 | B | 48 | 49 | 16 | 18 | small | large |
| B | 5 | B | 50 | 50 | 21 | 21 | small | large |
| B | 3 | E | 51 | 52 | 21 | 16 | small | large |
| B | 5 | E | 50 | 50 | 18 | 16 | small | large |

*A is a hydrosulfite bleached TMP pulp.
**B is a peroxide bleached TMP pulp.

Figure 2:
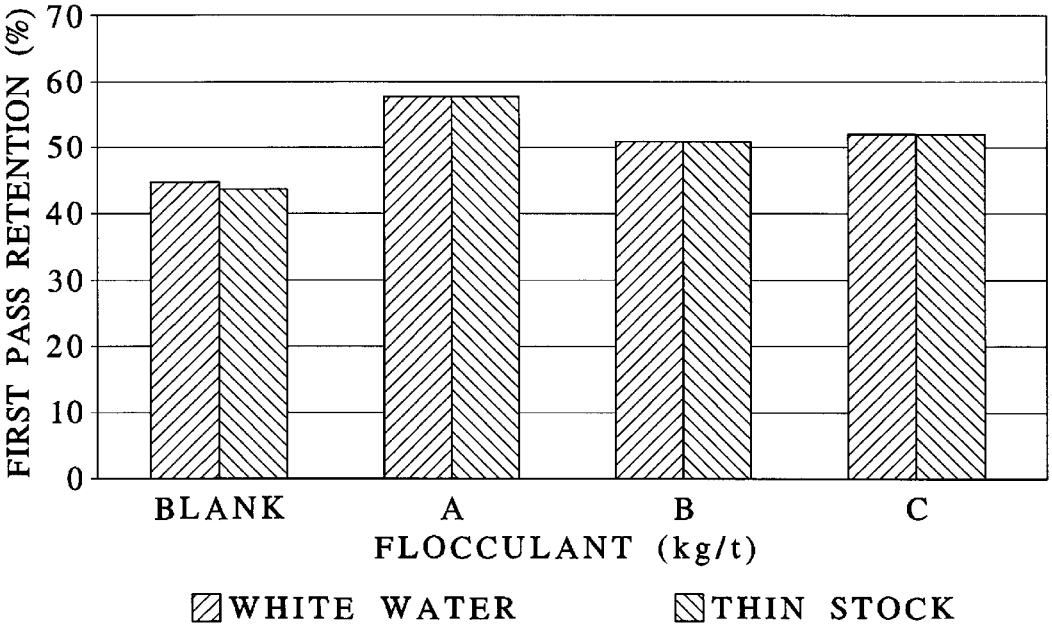
FIG. 2 illustrates, graphically, the effect of adding bentonite and flocculant to the white water and prior to the shear stages as opposed to the addition of bentonite and flocculant to the thin stock for hydrosulfite bleached TMP pulp.
Figure 3:
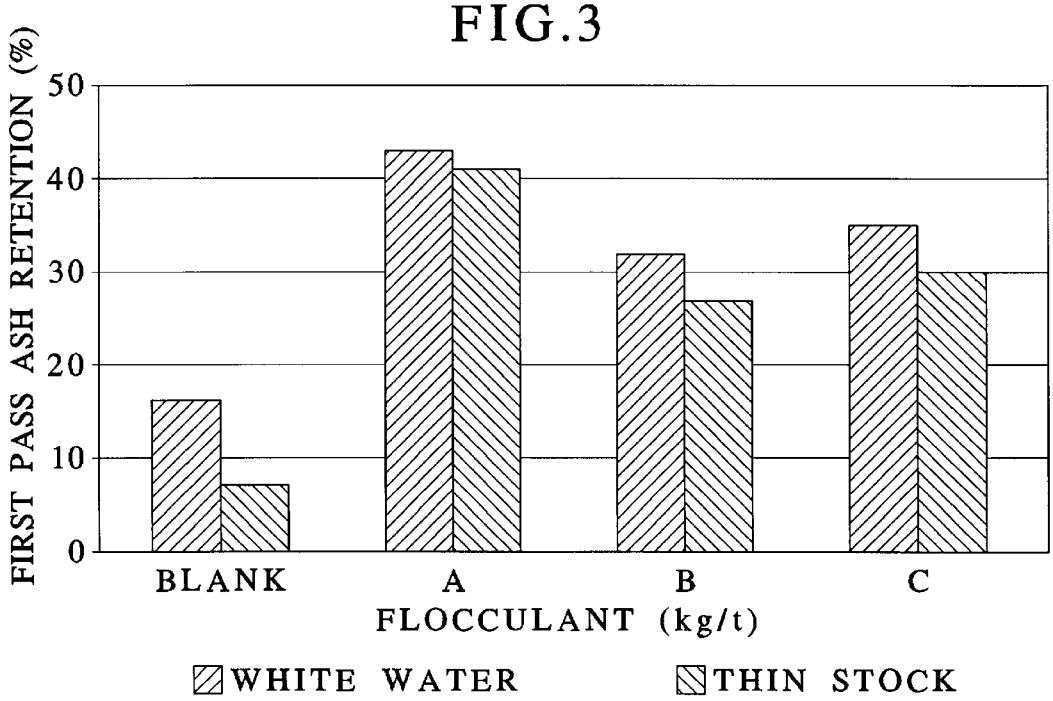
FIG. 3 illustrates, graphically, the effect of adding bentonite and flocculant to the white water and prior to the shear stages as opposed to the addition of bentonite and flocculant to the thin stock for hydrosulfite bleached TMP pulp.
Figure 4:
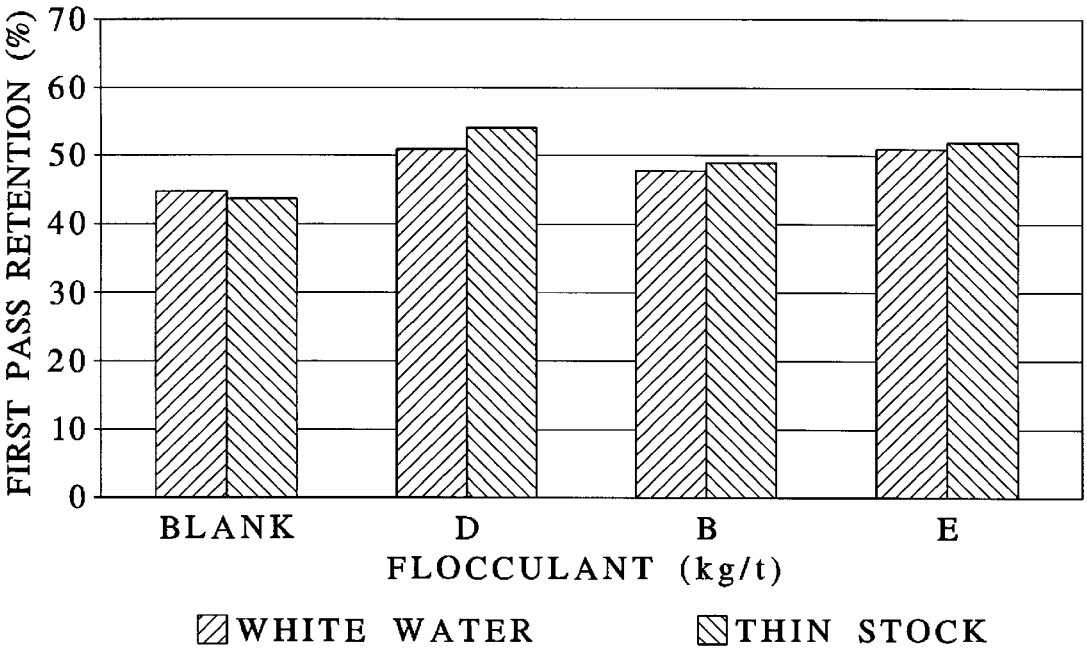
FIG. 4 illustrates, graphically, the effect of adding bentonite and flocculant to the white water and prior to the shear stages as opposed to the addition of bentonite and flocculant to the thin stock for peroxide bleached TMP pulp.
Figure 5:
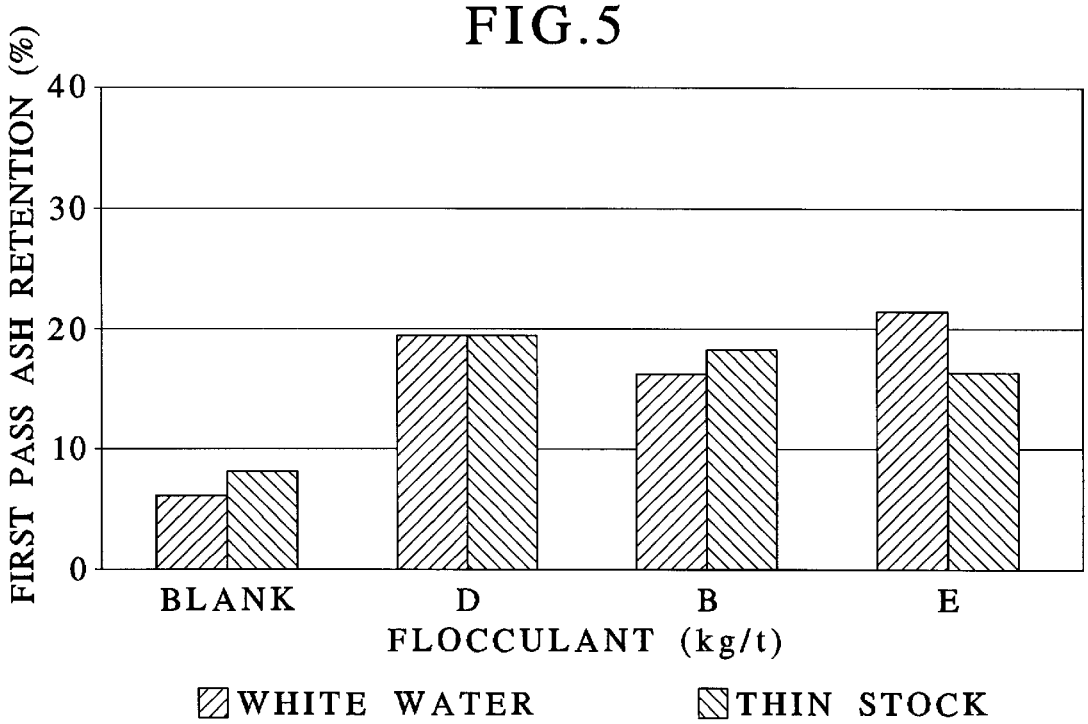
FIG. 5 illustrates, graphically, the effect of adding bentonite and flocculant to the white water and prior to the shear stages as opposed to the addition of bentonite and flocculant to the thin stock for peroxide bleached TMP pulp.

The results set forth in Table 1 are further illustrated in FIGS. 2–4. As shown in FIGS. 2 and 3, retention is not adversely affected by adding the bentonite and flocculant to the white water as opposed to adding the bentonite and flocculant to the thin stock. Specifically, the gray shaded bars at the left illustrate the retention when the flocculant and bentonite are added to the white water while the black shaded bars shown at the right illustrate the retention when the bentonite and flocculant are added to the thin stock. FIG. 2 is an illustration of the first pass retention; FIG. 3 illustrates the first pass ash retention. FIGS. 2 and 3 also illustrate the results for a hydrosulfite bleached TMP pulp. Similar results are achieved for a peroxide bleached TMP pulp as illustrated in FIGS. 4 and 5.

Referring to the visual flocc size is assessment provided in Table 1, it is also apparent that the addition of bentonite and flocculant prior to the shear stages will not adversely affect the formation of the paper. Specifically, the flocc sizes for the examples where the bentonite and flocculant was added to the white water are small and specifically, smaller than the flocc sizes for the addition of bentonite and flocculant to the thin stock. Flocc size remains small, thereby indicating that formation will not be adversely affected. Further, as illustrated in FIGS. 2–5, retention is not adversely affected by adding bentonite and flocculant to the white water. Thus, the present invention provides a means for adding bentonite and flocculant to a thin stock by way of adding the bentonite and flocculant to the white water which results in maintained retention qualities of the resulting product yet improve formation quality due to the lower flocc sizes. In the past, retention and formation qualities have been routinely inversely proportional to one another. That is, increases in retention level routinely resulted in negatively affecting formation of the produced paper. However, the present invention provides a method that allows to maintain level of retention with better formation.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

What is claimed:

1. A method of improving a balance of retention and formation in paper and paperboard production comprising the following steps:

adding bentonite and a flocculant to white water;

combining the white water flocculant, and bentonite with a thick stock suspension comprising water, cellulosic fibers, fillers, and other additives to form a thin stock suspension;

exposing the thin stock suspension to at least one shear stage; and draining the thin stock suspension on the wire screen to form the sheet.

2. A method of improving a balance of retention and formation in paper and paperboard production comprising the following steps:

adding bentonite and a flocculant to white water;

combining the white water, flocculant, and bentonite with a thick stock suspension comprising water, cellulosic fibers, fillers and other additives to form a thin stock suspension and adding additional flocculant to the thin stock suspension;

exposing the thin stock suspension to at least one shear stage; and draining the thin stock suspension on the wire screen to form the sheet.

3. A method of making filled paper by supplying an aqueous thin stock suspension comprising cellulosic fiber and bentonite to a head box, the head box being in communication with a wire on which the paper is formed and through which white water is drained, the wire being in communication with a white water silo which collects the white water drained from the wire, the white water silo being in communication with a first inlet of a fan pump, the fan pump comprising a second inlet in communication with an aqueous thick stock suspension comprising cellulosic fibers, fillers and other functional additives, the fan pump further comprising an outlet in communication with at least one pressurized screen, the pressurized screen being in communication with the head box, the method comprising the steps of:

adding bentonite and flocculant to the white water;

supplying the white water and the flocculant and bentonite to the first inlet of the fan pump and supplying the thick stock suspension to the second inlet of the fan pump;

mixing the white water, the bentonite, flocculant, and the thick stock suspension in the fan pump to produce the thin stock suspension; and supplying the thin stock suspension to the pressure screen.

4. A method of making filled paper by supplying an aqueous thin stock suspension comprising cellulosic fiber and bentonite to a head box, the head box being in communication with a wire on which the paper is formed and through which white water is drained, the wire being in communication with a white water silo which collects the white water drained from the wire, the white water silo being in communication with a first inlet of a fan pump, the fan pump comprising a second inlet in communication with an aqueous thick stock suspension comprising cellulosic fibers, fillers and other functional additives, the fan pump further comprising an outlet in communication with at least one pressurized screen, the pressurized screen being in communication with the head box, the method comprising the steps of:

adding flocculant and bentonite to the white water;

supplying the white water, flocculant, and the bentonite to the first inlet of the fan pump and supplying the thick stock suspension to the second inlet of the fan pump;

mixing the white water, the bentonite, flocculant, and the thick stock suspension in the fan pump to produce the thin stock suspension and adding flocculant to the thin stock suspension; and supplying the thin stock suspension to the pressure screen.

* * * * *